US012083446B2

(12) United States Patent
Almstead et al.

(10) Patent No.: US 12,083,446 B2
(45) Date of Patent: Sep. 10, 2024

(54) SELECTABLE REFRESHMENT DISPENSER TOY

(71) Applicant: Melissa & Doug, LLC, Wilton, CT (US)

(72) Inventors: Brett Almstead, Ridgefield, CT (US); George Lemoine, Trumbull, CT (US); Matt Burtonwood, West Yorkshire (GB); Wingo Siu, Guangdong (CN); Eugene Wang, Guangdong (CN)

(73) Assignee: Melissa & Doug, LLC, Wilton, CT (US)

( * ) Notice: Subject to any disclaimer, the term of this patent is extended or adjusted under 35 U.S.C. 154(b) by 220 days.

(21) Appl. No.: 17/889,941

(22) Filed: Aug. 17, 2022

(65) Prior Publication Data

US 2024/0058720 A1 Feb. 22, 2024

(51) Int. Cl.
*A63H 33/30* (2006.01)

(52) U.S. Cl.
CPC ..... *A63H 33/3022* (2013.01)

(58) Field of Classification Search
CPC ..... A63H 33/22; A63H 33/30; A63H 33/3022
See application file for complete search history.

(56) References Cited

U.S. PATENT DOCUMENTS 3,100,588 A * 8/1963 Pearson, Jr. ..... A63H 33/30 222/548
4,531,654 A * 7/1985 Guyon ..... G01F 11/021 446/483
5,176,581 A * 1/1993 Kumm ..... F16H 9/14 474/136
5,306,192 A * 4/1994 Caveza ..... A63H 33/3055 446/481
5,344,234 A * 9/1994 Caveza ..... A63H 33/3055 366/252
5,702,284 A * 12/1997 Gallegos ..... A63H 37/00 40/515
6,095,886 A * 8/2000 Beckman ..... A63H 33/3022 446/180
6,398,619 B1 * 6/2002 Webb ..... A63H 37/00 242/129
2019/0388796 A1 * 12/2019 Vanderbeek ..... A63H 13/10

* cited by examiner

*Primary Examiner* — John A Ricci
(74) *Attorney, Agent, or Firm* — Wissing Miller LLP

(57) ABSTRACT

A toy simulating a selectable beverage container may include a rotatable spindle having an axis of rotation arranged horizontally, a band connected with the spindle and arranged to wind onto and off the spindle, and a spigot arranged around at least a portion of the spindle, wherein the spigot comprises one or more openings arranged to allow the band to extend downward from the spindle. Rotation of the spindle in a first direction causes the band to unwind from the spindle and to extend from the spigot. A second band may be attached to another side of the spindle such that rotation of the spindle in a second direction causes the second band to extend down from the spindle.

15 Claims, 13 Drawing Sheets

SELECTABLE REFRESHMENT DISPENSER TOY

BACKGROUND OF THE INVENTION

Field of the Invention

The present disclosure relates to a refreshment dispenser toy that provides the experience of operating a beverage dispenser. More particularly, the present disclosure relates to an apparatus that safely provides the user with the experience of selecting and dispensing a beverage, such as a slushie, or the like.

Description of the Related Art

Some toys that simulate food kiosks and other retail equipment provide children with the experience of performing a task normally reserved for adults are known. Such toys may provide entertainment and can help children develop skills, such as arithmetic when making change as part of a "sale" of a "product." Playing games with such toys may help children develop social skills such as politely responding to questions and interacting with others, as an adult would do in a retail establishment.

A need exists for a toy that affords children the experience of being a cold beverage dispenser worker, providing the child the opportunity of operating a beverage dispenser that delivers syrup to a beverage or snack such as a shaved ice beverage. Operating such equipment is normally out of reach for children. Actual equipment may be dangerous for children to operate. Toys that allow children to engage in an activity they typically would not be allowed to do because it may be dangerous or the equipment may be too large, expensive, or impractical to have in a home, provide an additional source of excitement. Equipment that actually dispenses flavored liquids may not be suitable for children because it could lead to spills, stains, and food waste. At the same time, children are exposed to such equipment when visiting a retail establishment that sells such treats or refreshments and thus children associate pleasant flavors, colors and other memories with such equipment. For this reason, playing with such toys may engender additional excitement.

BRIEF SUMMARY OF THE INVENTION

Embodiments of the disclosure provide a toy that includes a mechanism to simulate the selection and dispensing of beverages and other refreshments.

According to an aspect of the disclosure, toys embodying the disclosed structure can be created with a variety of shapes and configurations to simulate various types of beverage dispensers.

According to another aspect of the disclosure, the structure is formed from components that are simple to manufacture and assemble.

According to another aspect of the disclosure, toys embodying the disclosed structure are lightweight and easy to store and transport.

According to another aspect of the disclosure, toys embodying the disclosed structure are durable.

According to one embodiment of the disclosure there is provided a toy simulating a selectable beverage dispenser comprising a spigot having an opening and housing a first band of a first color and a second band of a color different from the first color, and a handle connected to an actuator and configured to move the actuator to a first position and to a second position, wherein, when the actuator is moved to the first position, the actuator moves the first band to protrude out through the opening of the spigot and to withdraw the second band through the opening of the spigot so that the second band is entirely within the spigot, and wherein when the actuator is moved to the second position, the actuator moves the second band to protrude out through the opening of the spigot and to withdraw the first band through the opening of the spigot so that the first band is entirely within the spigot. The actuator may comprise an actuator disk connected to the handle, wherein the handle rotates the disk clockwise to attain the first position, and the handle rotates the disk counterclockwise to attain the second position. The handle may rotate the actuator disk about a horizontal axis and the opening of the spigot may face downward. The actuator may comprise a block positioned inside the spigot, the block comprising an outer surface, wherein to attain the first position the actuator winds at least a portion of the first band around a first portion of the outer surface of the block and unwinds at least a portion of the second band from a second portion of the outer surface, and wherein to attain the second position the actuator winds at least a portion of the second band around a second portion of the outer surface of the block and unwinds at least a portion of the first band from the first portion of the outer surface. The actuator may comprise an actuator disk and moving the handle may rotate the actuator disk and the block.

The toy may further comprise a spout disk connected with the spigot, and a base. The actuator may comprise an actuator disk held rotatably captive between the spout disk and the base. Each of the first and second bands may comprise one or more of a string, a strip of fabric, a soft plastic material, or a synthetic rubber.

The handle may be configured to rotate the actuator to a third position, wherein to attain the third position the actuator withdraws the first and second bands through the opening of the spigot so that the first and second bands are entirely within the spigot. To attain the first position of the actuator, the handle may be moved to a first handle position toward the righthand side of a user, and to attain the second position of the actuator the handle may be moved to a second handle position toward the lefthand side of the user.

The handle may be configured to be moved to a third handle position between the first and second handle positions wherein the actuator is configured to attain a third position. When the handle is moved to the third handle position the actuator may attain the third position of the actuator wherein the actuator withdraws the first and second bands through the opening of the spigot so that the first and second bands are entirely within the spigot. A transparent or translucent spout disk may be connected with the spigot, and a colored disk may be positioned behind the transparent or translucent spout disk, wherein moving the handle rotates the colored disk about a horizontal axis, with the rotation of the colored disk being visible to a user through the transparent or translucent spout disk.

According to one embodiment the toy simulates a slushy beverage dispenser. The toy may further comprise a toy snow cone dispenser.

According to another embodiment, there is provided a toy simulating a selectable beverage dispenser comprising a spigot having an opening and housing a first band of a first color and a second band of a color different from the first color and a handle connected to an actuator and configured to move the actuator to a first position and to a second position, wherein when the actuator is moved to the first position, the actuator moves the first band to protrude out through the opening of the spigot and to withdraw the second band through the opening of the spigot so that the second band is entirely within the spigot, wherein when the actuator is moved to the second position, the actuator moves the second band to protrude out through the opening of the spigot and to withdraw the first band through the opening of the spigot so that the first band is entirely within the spigot, wherein the actuator comprises an actuator disk connected to the handle, wherein the handle rotates the disk clockwise to attain the first position, and the handle rotates the disk counterclockwise to attain the second position. The toy may include a block positioned inside the spigot with the block connected to the actuator disk and configured to rotate with the actuator disk. The block may comprise an outer surface. To attain the first position the actuator may wind at least a portion of the first band around a first portion of the outer surface of the block and unwind at least a portion of the second band from a second portion of the outer surface. To attain the second position the actuator may wind at least a portion of the second band around a second portion of the outer surface of the block and unwind at least a portion of the first band from the first portion of the outer surface.

According to another embodiment of the disclosure there is provide a toy simulating a selectable beverage container comprising a rotatable spindle having an axis of rotation arranged horizontally, a band connected with the spindle and arranged to wind onto and off the spindle, and a spigot arranged around at least a portion of the spindle, wherein the spigot comprises one or more openings arranged to allow the band to extend downward from the spindle, wherein rotation of the spindle in a first direction causes the band to unwind from the spindle and extend from the spigot and rotation in a second direction causes the band to wind onto the spindle and withdraw into the spigot.

BRIEF DESCRIPTION OF THE DRAWINGS

The above-described and/or other aspects of the disclosure will be more apparent in view of details and exemplary embodiments of the disclosure with reference to the accompanying Drawings, in which.

DETAILED DESCRIPTION OF EXEMPLARY EMBODIMENTS

Figure 1:
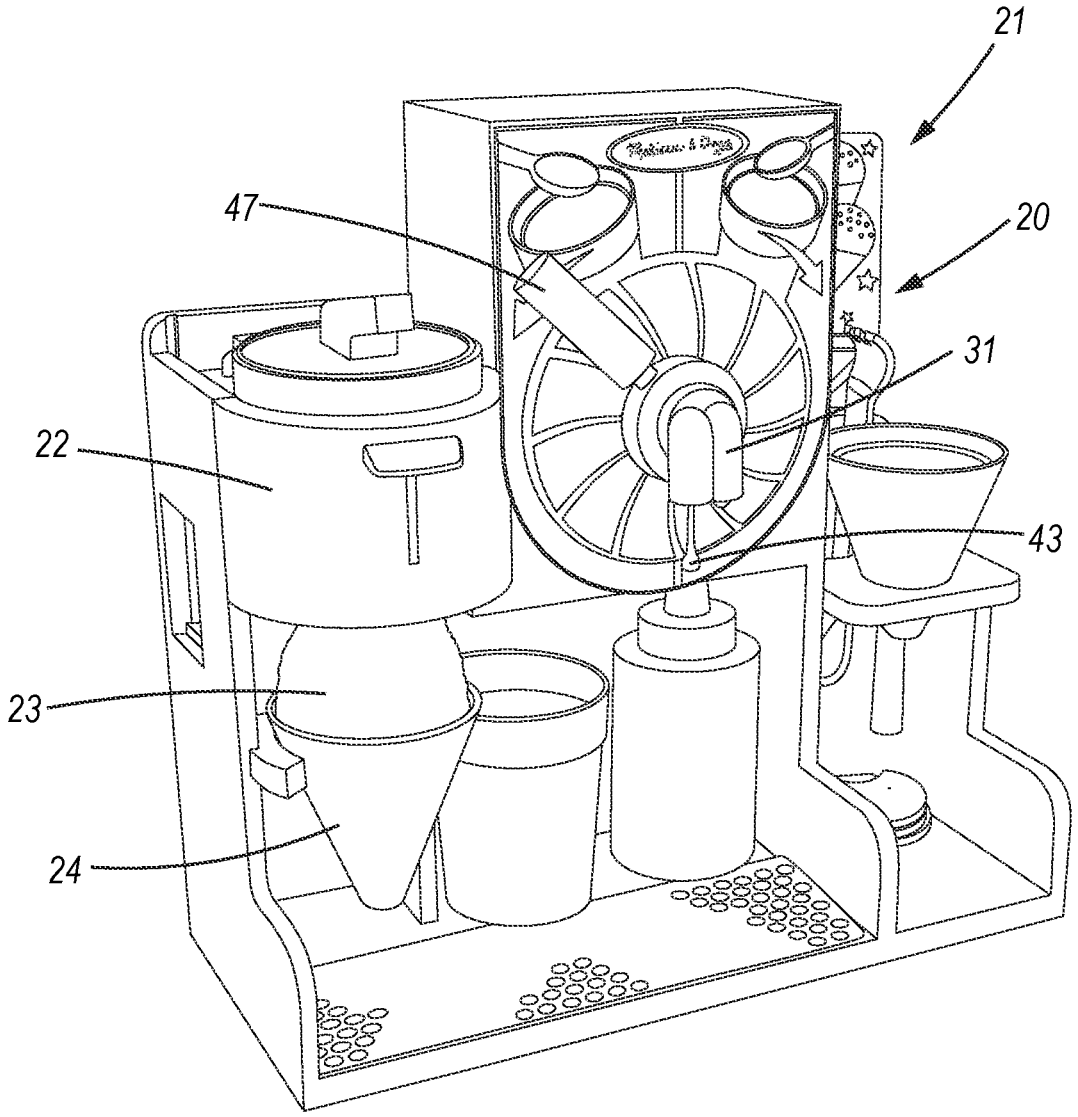
FIG. 1 is a perspective view of an example of a refreshment station toy including the toy selectable beverage dispenser, according to an aspect of the disclosure.

Exemplary embodiments of the disclosure will now be described below by reference to the attached Figures. The described exemplary embodiments are intended to assist the understanding of the invention and are not intended to limit the scope of the invention in any way. Like reference numerals refer to like elements throughout.

As used in this description, the term "proximal" refers to the direction toward the user operating the apparatus and the term "distal" refers to the direction away from the user operating the apparatus.

FIG. 1 illustrates, by way of example, a refreshment dispensing station toy 21 that includes a toy selectable beverage dispenser 20. Also illustrated in FIG. 1 are other possible components of a toy simulating a refreshment dispensing station 21, besides the selectable beverage dispenser toy 20, such as a snow cone dispenser 22 dispensing a snow cone 23. Refreshment dispensing station 21 may also include additional or alternative toy refreshment dispensing elements and toy refreshment processing, handling and storage equipment and tools.

Figure 2A:
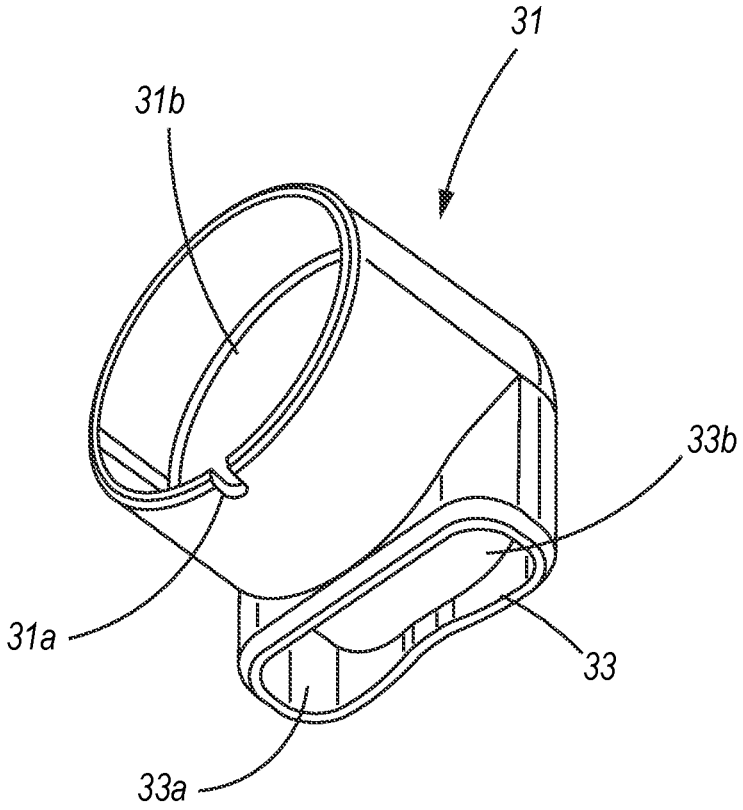
FIGS. 2A-E provide views of components forming the toy selectable beverage dispenser shown in FIG. 1 according to embodiments of the disclosure.
Figure 2B:
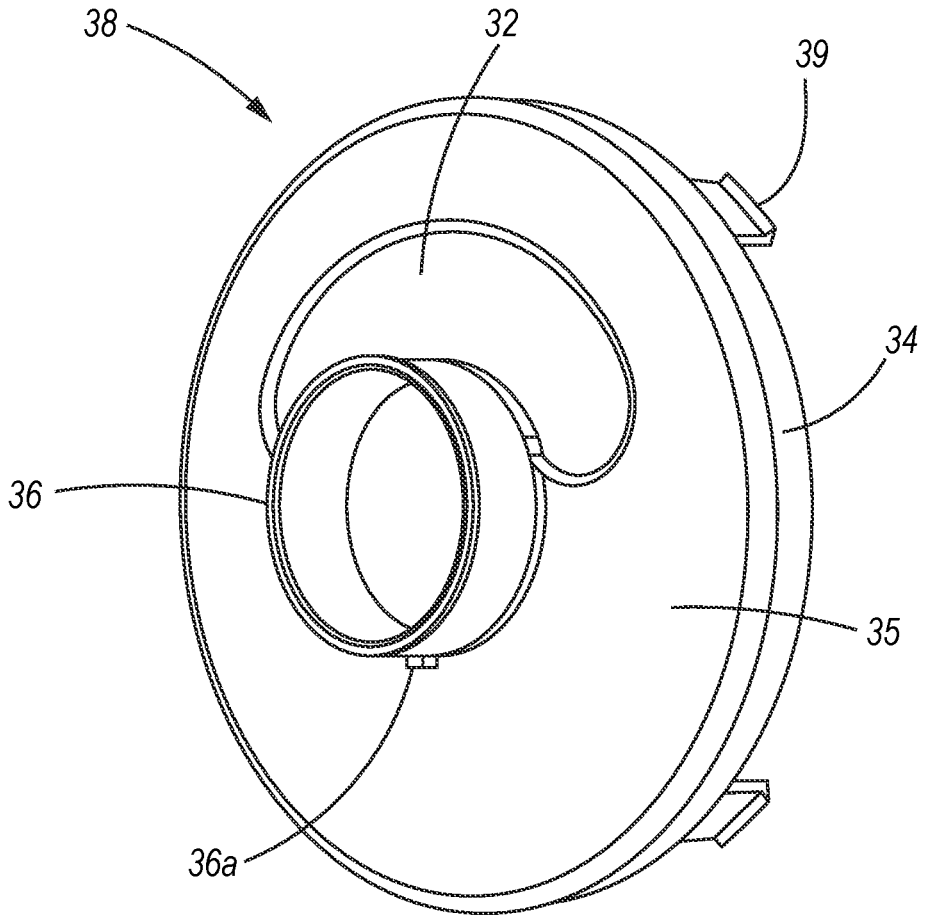
Figure 2C:
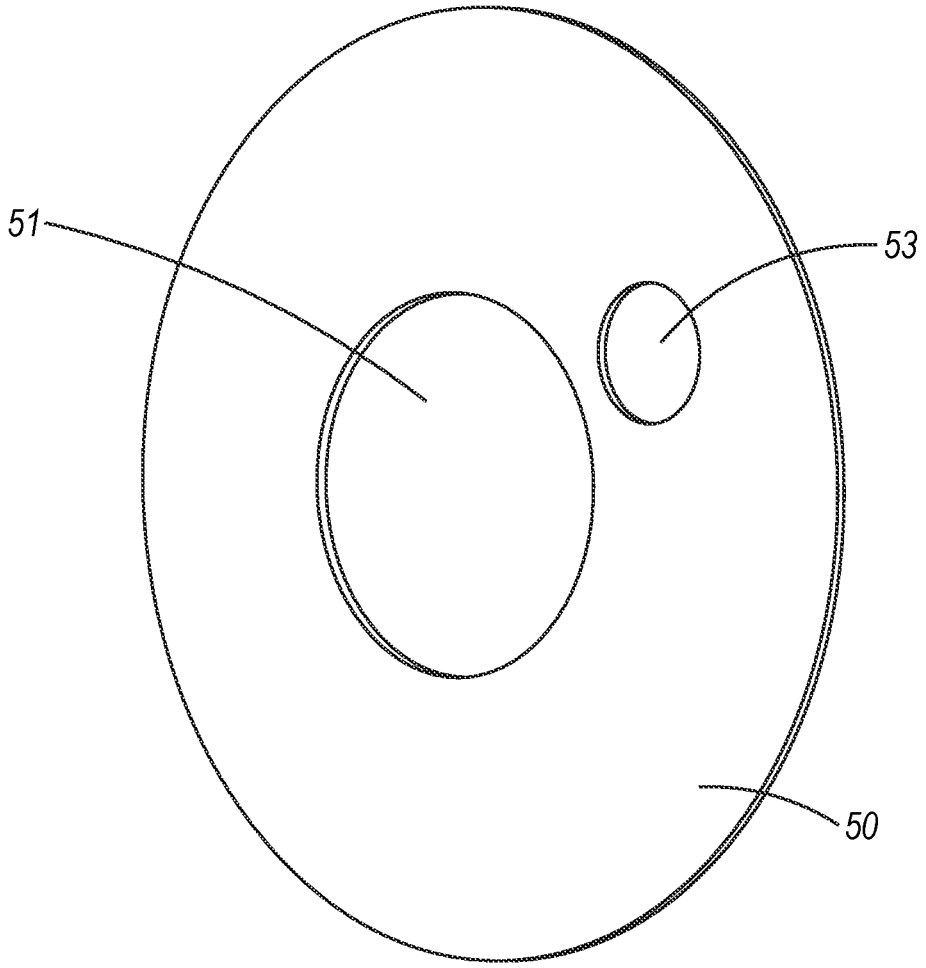
Figure 2D:
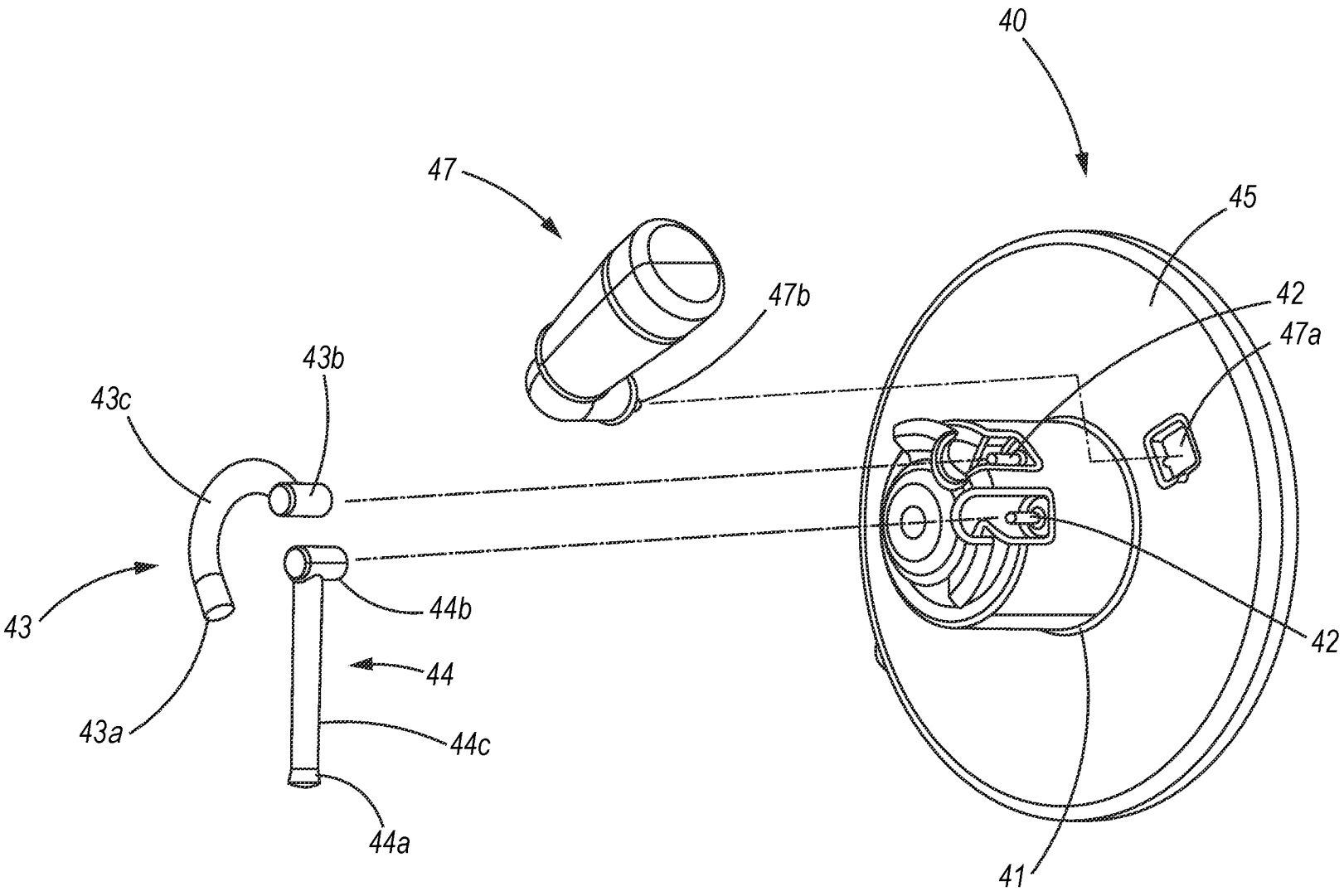
Figure 2E:
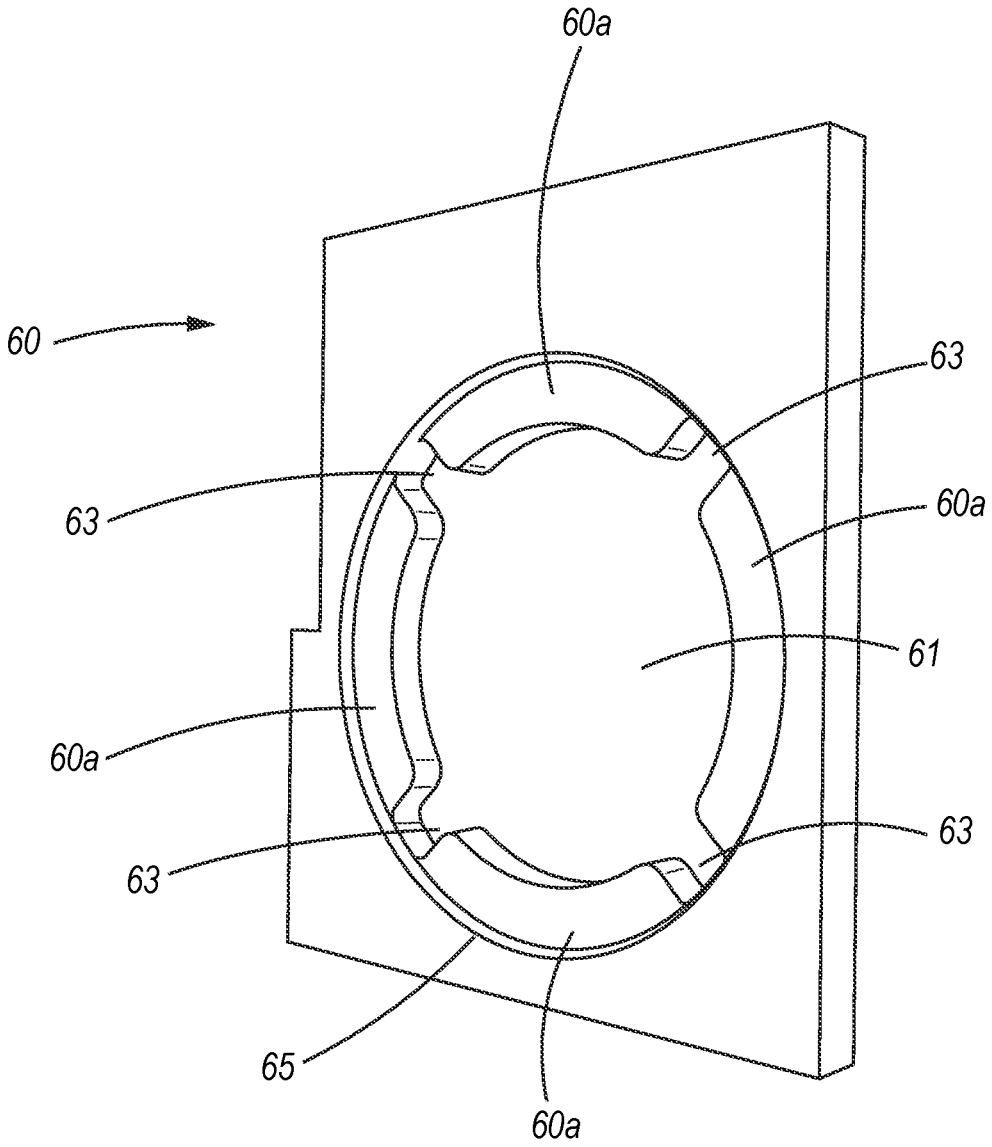
Figure 3:
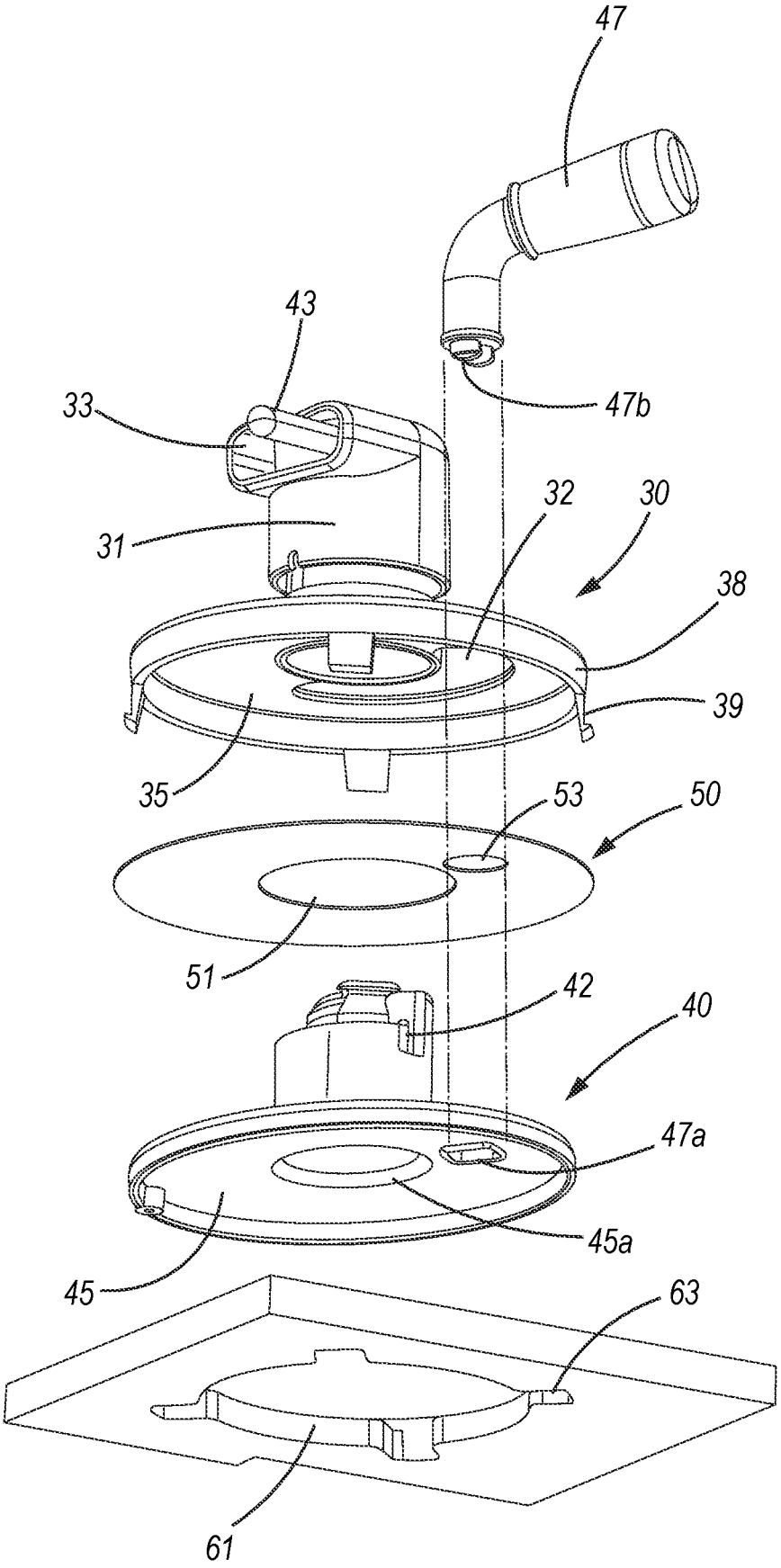
FIG. 3 provides an exploded view of the toy selectable beverage dispenser shown in FIG. 1.

According to one embodiment, as illustrated in FIGS. 2A-2E and 3, such a toy selectable beverage dispenser 20 may include a spigot 31 with spout opening 33, as illustrated in FIG. 2A. Spigot 31 may be received on spigot base 36 of spout apparatus base 38, illustrated in FIG. 2B. Spigot base 36 may include, or may be attached with, or may be formed integrally with, or may otherwise sit on top of, spout disk 35 of spout apparatus base 38 and extend in the proximal direction from spout apparatus base 38, as also illustrated in FIGS. 2B and 3. A distal portion of spigot 31 may be positioned around spigot base 36 and secured thereon so that the spigot and base are positioned coaxially. Tabs 39 project distally of spout apparatus base 38. As shown in FIG. 3 handle 47, in an assembled state of the toy selectable beverage dispenser 20, may protrude through spout base aperture 32 of spout apparatus base 38.

FIG. 2C illustrates cover disk 50 that may include cover disk main aperture 51, which in the assembled state may accommodate and be positioned around block 41 of actuating mechanism 40, as discussed below. Cover disk 50 may also have cover disc handle aperture 53 that accommodates handle 47 so that it projects therethrough in an assembled state. Cover disk 50, in the assembled state, may be positioned behind and inside spout apparatus base 38, coaxial with spout disk 35, as shown in FIG. 3. According to a further embodiment, no cover disk 50 is provided. Cover disk 50 may be positioned in front of, and coaxial with, actuator disk 45 of actuator mechanism 40, as illustrated in FIG. 3.

As shown in FIG. 2D, actuator mechanism 40 includes block 41 and actuator disk 45, which may be formed integrally with one another, or may be attached in an assembled state. Handle receiving portion 47*a*, which may be provided, for example, as an aperture, slot or tab, to receive a distal portion 47*b* of handle 47 is provided on actuator disk 45. Handle 47 may protrude through cover disk main aperture 51 of cover disk 50, as shown in FIG. 3.

As shown in FIG. 2E, dispenser base 60 may include base groove 65 concentric with dispenser base aperture 61 of dispenser base 60. In an assembled state, a distal portion of actuator disk 45 may protrude distally into base groove 65 of dispenser base 60 illustrated in FIGS. 2E and 3 and may be rotatably secured therein. Also illustrated in FIG. 2E are dispenser base tab apertures 63 designed and sized to receive and to secure therein tabs 39 of spout aperture base 38. Dispenser base 60 may be fastened to a wall of the toy 21 or may be provided as part of such a wall.

FIG. 3 is an exploded view of the components of dispenser 20 according to one embodiment of the disclosure. Spout apparatus 30 includes spigot 31, spout apparatus base 38 and spout apparatus tabs 39. Spout apparatus base 38 may also include a spout base handle aperture 32 that may be sized and shaped to accommodate handle 47 in its various positions and the movement of the handle 47 between leftmost and rightmost positions as described more fully below.

Figure 4:
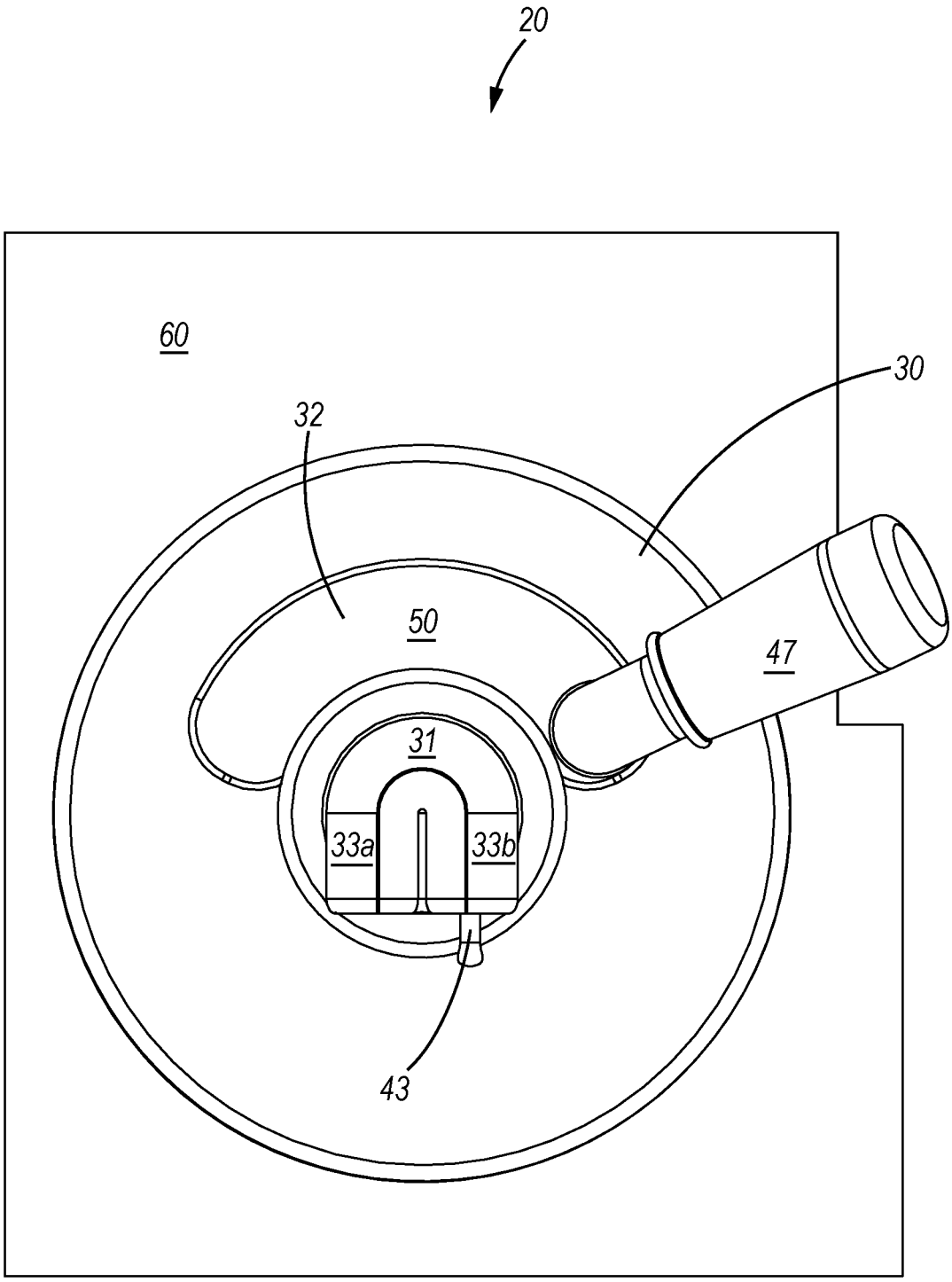
FIG. 4 is a front view of the toy selectable beverage dispenser of FIG. 1.

FIG. 3 illustrates handle 47 protruding through spout base handle aperture 32. In the view of FIG. 3 handle 47 is positioned to the right causing right band 43B to protrude out from spout opening 33 of spigot 31. FIG. 4 shows a front view of dispenser 20 also with handle 47 positioned to the right and band 43 protruding from spigot 31.

FIG. 3 illustrates cover disk 50, which in an assembled state of the toy selectable beverage dispenser 20 may be held captive, together with actuator disk 45 of the actuator mechanism 40 between spout disk 35 of spout base 38 and dispenser base 60 in a way that allows rotation of cover disk 50 and actuator disk 45.

Figure 5A:
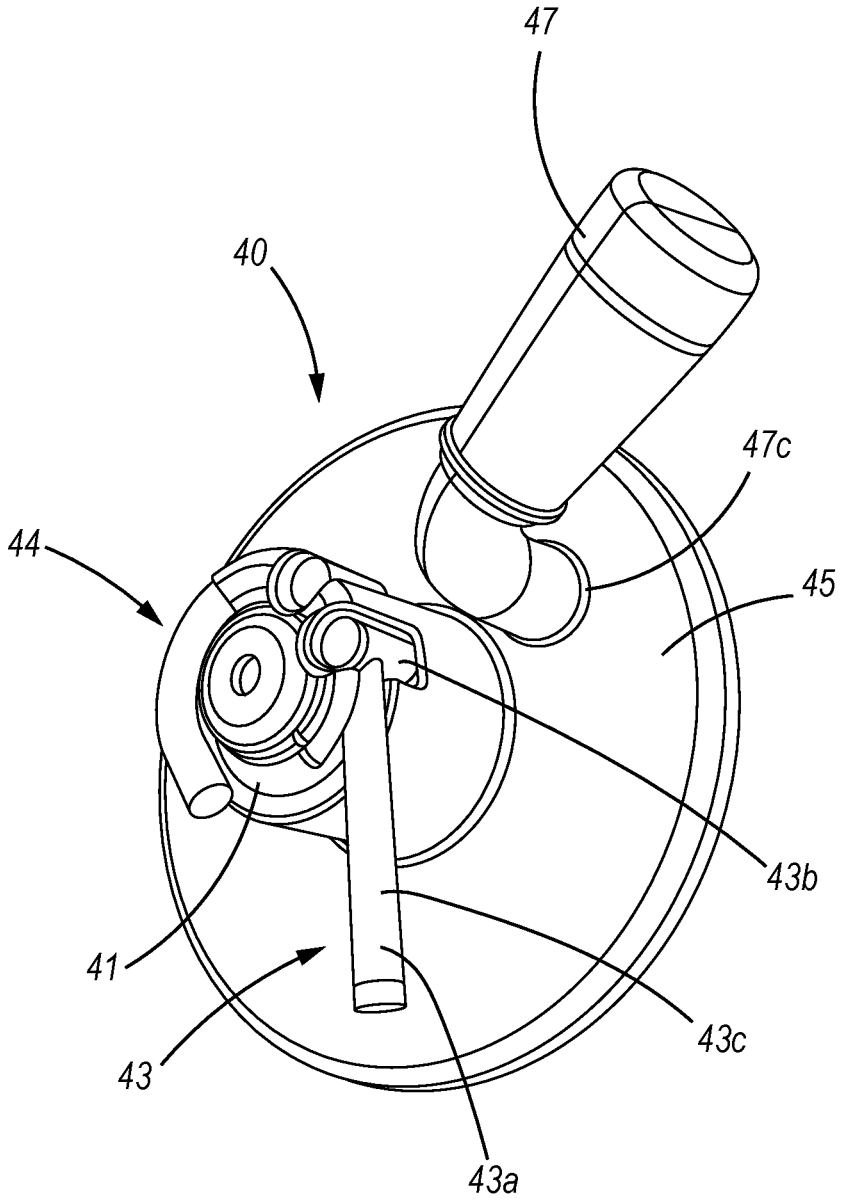
FIG. 5A is a front, bottom and side perspective view of an actuating mechanism of the toy selectable beverage dispenser toy of FIG. 1.
Figure 5B:
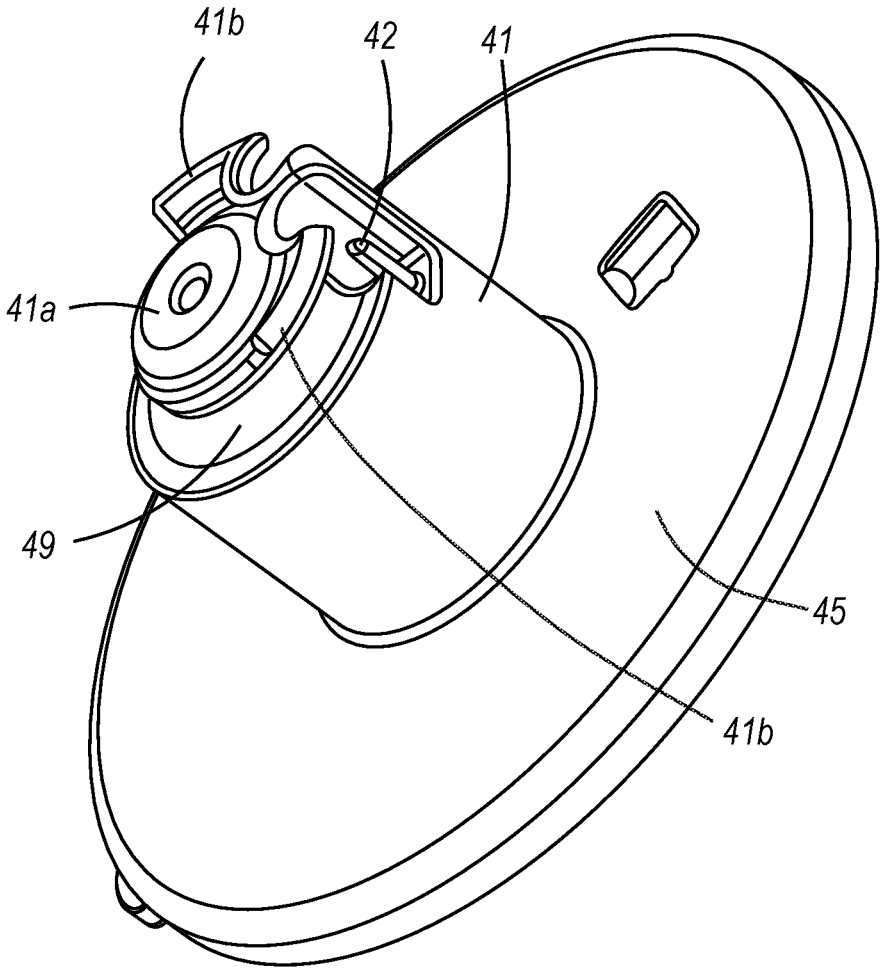
FIG. 5B is a front, bottom and side perspective view of the actuator mechanism of the toy selectable beverage dispenser of FIG. 1, without the handle to more clearly show features of the disclosure.

FIG. 5A shows block 41 at a center, or near a center, of actuator disk 45 with bands 43 and 44 connected with the block. FIG. 5B shows the apparatus with bands 43, 44 removed for clarity of the disclosure. Block 41 defines a band path 49 positioned near a proximal end of block 41. Block 41 may be provided as a cylinder coaxial with actuator disk 45. Block 41 may include a hollow interior cavity. Providing such a cavity may reduce the amount of material used to form block 41 and may reduce the cost and weight of the apparatus.

In the assembled state, actuator mechanism 40 is positioned so that disk 45 fits within base groove 65 and is rotatable about the center of disk 45. Tabs 39 project distally from spout apparatus base 38 of spout apparatus 30 and are received inside dispenser base tab apertures 63 so as to secure the spout apparatus 30 to base 60. This arrangement allows actuator mechanism 40 to rotate within spout apparatus base 38.

According to a further embodiment, instead of, or in addition to capturing actuator mechanism 40 between apparatus base 38 and dispenser base 60, a dowel may be mounted to dispenser base 60 or else mounted to another stationary portion of toy 21. According to this embodiment, spout disk 35, cover disk 50, and actuator disk 45 are mounted on the dowel such that cover disk 50 and actuator disk 45 are rotatable about the dowel, while spout apparatus base 38, including spout disk 35 and spigot 31 remain fixed on the dowel. For example, a center of spout disk 35 is fixedly connected with the dowel, and cover disk 50, actuating disk 45 and block 41 are rotatably mounted on the dowel projecting through a central aperture of actuator disk 45 and of block 41. According to an aspect of this embodiment, the dispenser base 60 may not be necessary.

FIG. 5A illustrates an actuator mechanism 40 according to an aspect of the disclosure. For clarity, in this figure mechanism 40 is shown without spout 31, cover 50 or spout apparatus base 38. Handle 47 is attached at handle receiving portion 47*c* of actuator disk 45. Left and right bands 43, 44 are connected to block 41 near the proximal end of the block. Left band 44 is shown as being in a coiled, withdrawn position, while right band 43 is shown in the protruding out, straight position, such that in an assembled state of the toy selectable beverage dispenser left band 44 would not be visible from the outside, while right band 43 would be visible protruding out through spout opening 33. This arrangement of the bands 43, 44 corresponds to handle 47 being positioned to the right.

FIG. 5B illustrates actuator disk 45, which may be integrally formed concentrically or attached to block 41. Band paths 49 are provided near the proximal end of block 41 for guiding left and right bands 43, 44. Band path 49 is defined by an outer flange 49*b* that projects laterally from the proximal end of block 41 and is concentric with block 41. Outer flange 49*b* need not be formed to totally surround protruding portion 41*a* of block 41. According to one embodiment, outer flange 49*b* is formed of left and right portions for guiding the left and right bands 44 and 43, respectively, and each of left and right portions of outer flange 49*b* has an outer diameter that extends 90 degrees or less than 90 degrees about the rotational axis of block 41. According to an aspect of the disclosure, the diameter of each portion extends approximately 45 degrees or less than 45 degrees about the axis of rotation of block 41.

Figure 6A:
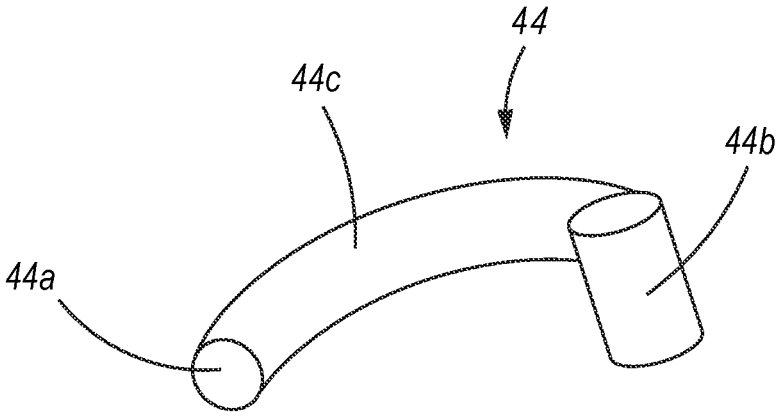
FIGS. 6A-B are perspective views of bands of the toy selectable beverage dispenser of FIG. 1, with FIG. 6A showing the band in the withdrawn, coiled configuration and FIG. 6B showing the band in an extended, protruding configuration.
Figure 6B:
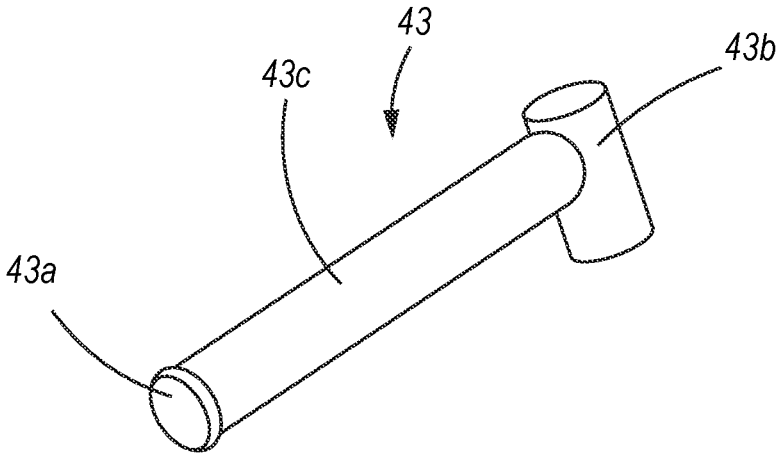
Figure 7:
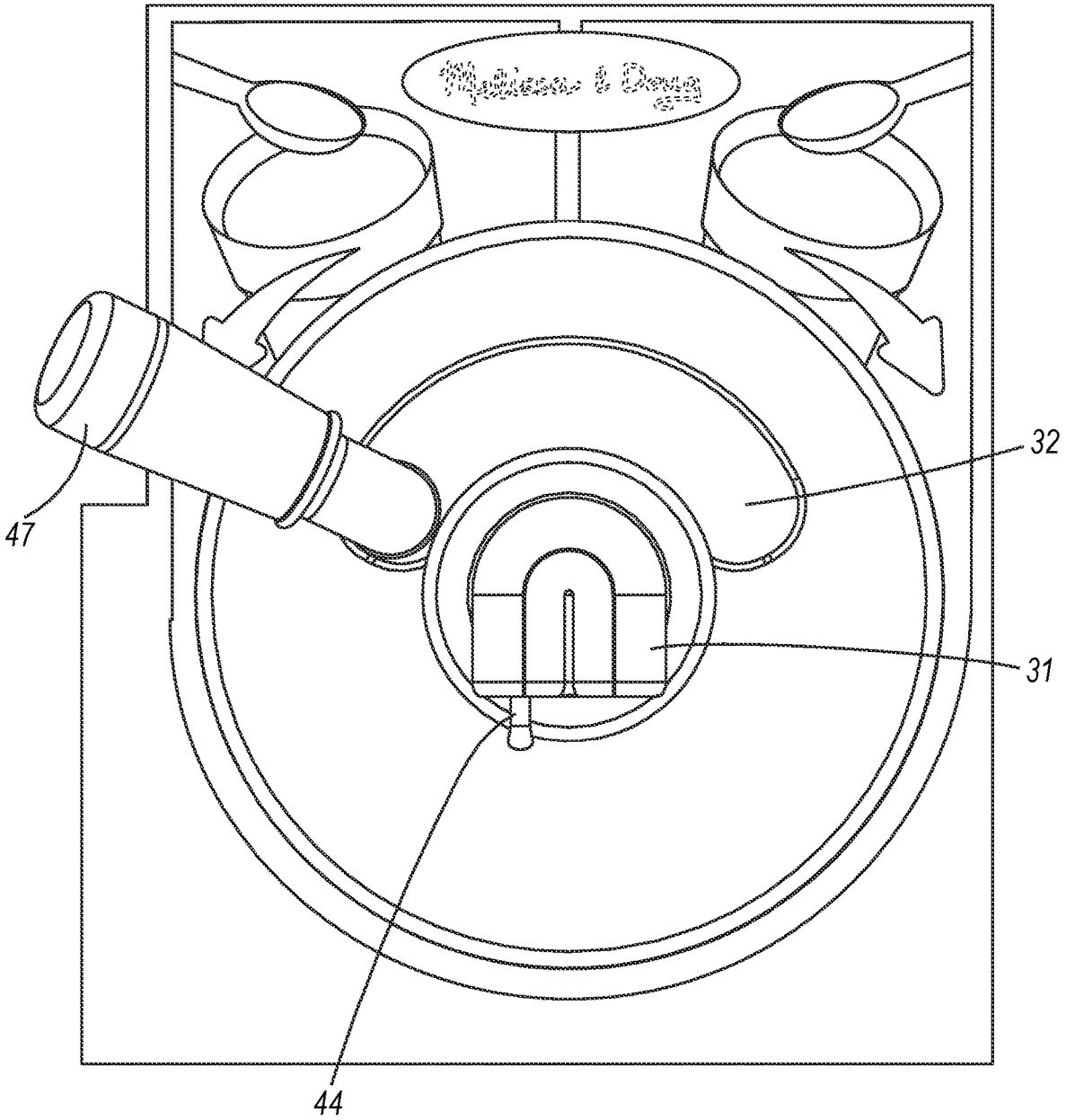
FIG. 7 is a front view of the toy selectable beverage dispenser of FIG. 1 with the handle positioned on the lefthand side.

Illustrated in FIGS. 6A and 6B are bands, respectively, in the withdrawn configuration (FIG. 6A) and in the protruding out configuration so that it is visible from the outside below spigot 31 (FIG. 6B). Each band includes a top portion 43*b*, 44*b*, made of a different material, for example, of a harder material, such as plastic or metal, than a central portion 43*c*, 44*c* of the band. In an assembled state, top portion 43*b*, 44*b* of each band attaches the band near the proximal end of block 41. According to an embodiment, top portion 43*b*, 44*b* includes a hole shaped to accept insertion of pin 42 extending proximally on block 41, as shown in FIG. 5B. The engagement between top portion 43*b*, 44*b* and pin 42 allows top portion 43*b*, 44*b* to rotate with respect to block 41, allowing band 43, 44 to extend fully downward when handle 47 is rotated to the left or right. According to another embodiment a bottom portion 43*a*, 44*a* of each band is made of a different material than the central portion 43*c*, 44*c* of the band. For example, central portion 44*c* of each band may be made of a soft plastic material, synthetic rubber, textile, or fabric or the like, or a combination of the foregoing, while bottom portion 43*c*, 44*c* may be made of a softer material so as to mitigate risk of injury as the band is made to protrude out from spout opening 33.

Figure 8:
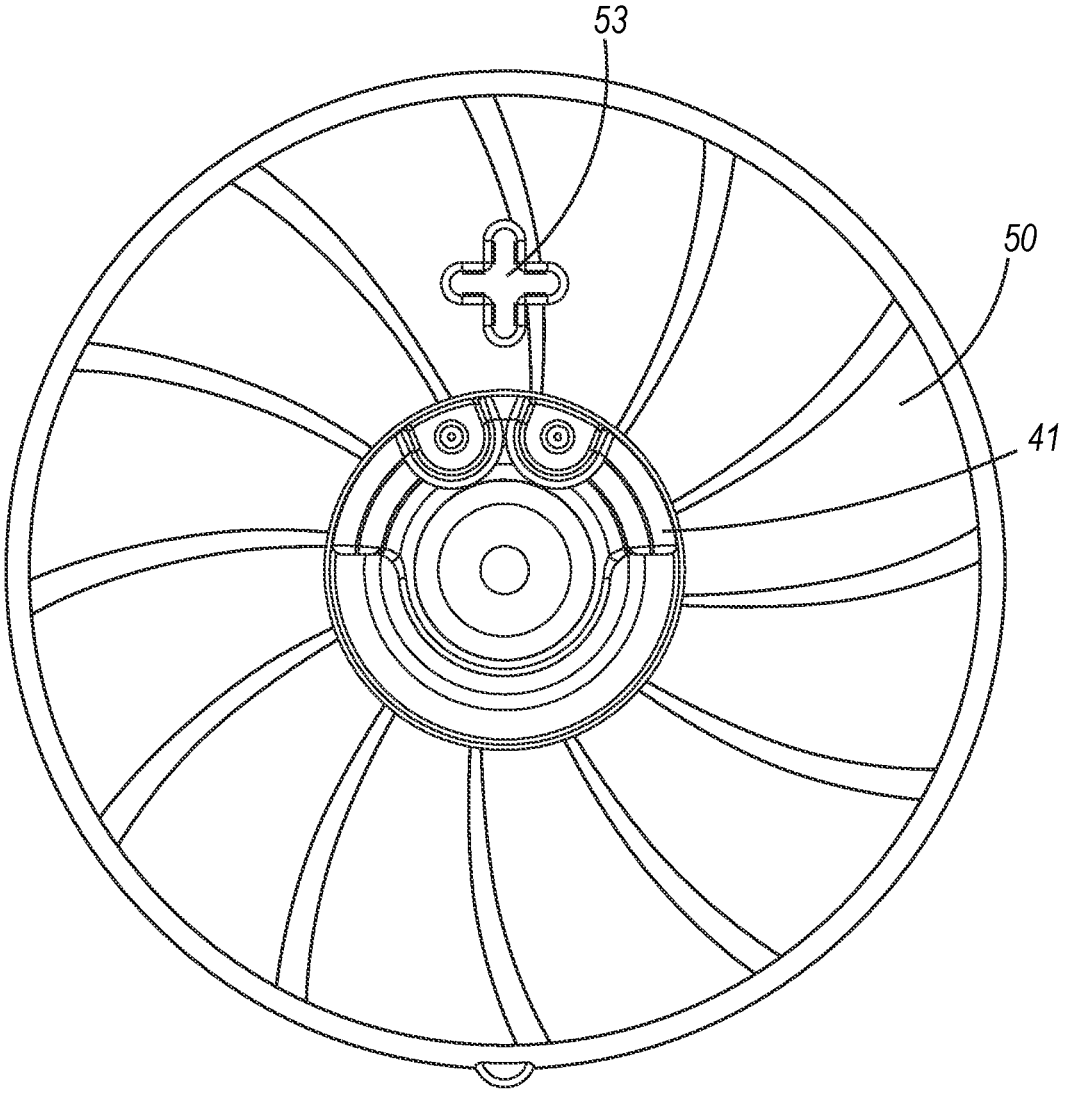
FIG. 8 is a front view of the cover disk provided as a color wheel of the toy selectable beverage dispenser toy of FIG. 1.

According to an embodiment, spout base 38 is formed from a transparent material, for example, polycarbonate, so that cover 50 is visible. Cover 50 and/or actuator disk 45 may be decorated with colors, as shown in FIG. 8. According to one embodiment, left and right sides of cover 50 may be colored differently from each other, and the left side may be colored the same as left band 43 and the right side may be colored the same as right band 44. According to another embodiment, cover 50 is omitted and decorations are applied to disk 45. Spigot 31, or substantial parts thereof, may also be transparent or translucent to reveal more of the colors. According to a further embodiment, cover disk 50 is colored as described while actuator disk is a neutral color or transparent or translucent.

According to a further embodiment, movement of the handle 47 is geared so that a smaller movement of handle 47 produces a relatively greater movement of the actuator disk 45. According to this further embodiment, the spinning of the colored patterns on the front surface of actuator disk 45 is amplified in response to the movement of handle 47.

According to an exemplary embodiment, spigot 31 dispenses one of the bands in accordance with a selection of the user made by operating the handle to simulate dispensing of liquid, such as a viscous liquid. FIG. 4 illustrates, by way of non-limiting example, handle in the righthand position, which has caused right band 43 to protrude through the righthand side 33*b* of opening 33 of spigot 31. In particular, as the handle 47 is moved by the user from left to right, actuator disk 45, attached with handle, rotates clockwise (as seen from the front). Spout apparatus 30 as illustrated in FIGS. 2A and 3 includes an aperture 32 that accommodates handle 47 so as to allow movement of handle 47 between left-most and right-most positions while spout disk 35 and spout 31 remain stationary. Sufficient clearance is provided between spout disk 35 and dispenser base 60 to allow actuator mechanism 40 to rotate substantially freely about a horizontal axis when handle 47 is rotated.

Block 41, which may be integrally formed or may be otherwise attached to actuator disk 45, rotates together with actuator disk 45 and is it does, bands 43, 44 are controlled. According to an aspect of the disclosure, positioning handle 47 on the righthand position as shown in FIG. 4 causes left band 44 to withdraw and wind up inside its band path 49 about block 41. At the same time, the rotation of block 41 causes right band 43 to protrude out through the right side of opening 33 of spigot 31. Similarly, moving handle 47 to the lefthand side causes counterclockwise rotation of actuator disk 45 and block 41, which causes left band 44 to protrude out and right band 43 to recede and be wound in its band path 49 about block 41. The correspondence between the right and left positioning of the handle and the visibility of the band on the corresponding side may make operation of toy 20 intuitive and may make for more faithfully simulation of a real beverage dispenser or tap.

Right band 43 may be made of colored fabric or string of a color different than the color of left band 44. Also, each band may be decorated with a variety of colors different from the colors of the remaining band, or decorated with a different pattern or sequence of colors than the colors of the remaining band. Protruding through opening 33 of band 43 or 44 gives a visual impression of the dispensing of a beverage, such as a fruit flavored viscous beverage. Bands 43, 44 are of colors different from one another so as to simulate different flavored beverages being dispensed. While shown as being located above spigot 31, handle 47 may also be located below spigot 31 or to a side thereof.

While the block 41 is sometimes described as a cylinder it will be understood that block 41 need not be substantially cylindrical. In the alternative, only a portion thereof is cylindrical or substantially cylindrical. In addition, band path 49, while illustrated as being defined, in part, by right and left portions of flange 49*b*, may be made of many more such portions, each portion protruding laterally at various portions of the perimeter of block 41 to guide the bands.

Also, while referred to herein sometimes as an actuator disk 45, it will be understood that a portion of a disk, for example, half a disk (180 degrees) or a third of a disk (120 degrees) shape, may be provided. For example, handle may rotate such a partial disk shape clockwise or counterclockwise to attain the left and right positions, and optionally the middle position, to control left and right bands 43, 44, in a manner similar to clockwise and counterclockwise rotation of a circular actuator disk 45 described above as controlled by handle 47 to control bands 43, 44. Similarly, cover disk 50 may be a partial disk shape, such as a half disk (180 degrees) or a third of disk (120 degrees) or smaller. Correspondingly, spout disk may also be provided as only a partial disk shape (less than 360 degrees, as described above).

Instead of a single opening 33 of spigot 31, separate left and right nozzles (not illustrated) may be provided for, respectively the left and right bands 43 an 44 to move through and may thus provide further guiding support to the bands. It will be understood that when a respective band 43, 44 is withdrawn into the respective nozzle inside of spigot 31, the respective band 43, 44 would not be visible from the outside, at least from the front of toy 20. In this way, bands 43, 44 may simulate dispensing of a viscous beverage, such as a slushy. Printing or decals may be provided on disk 50 and elsewhere on toy 20 and toy station 21 to make the toy more similar to an actual slushy dispenser and refreshment station.

According to an exemplary embodiment described herein, engagement tabs 39 are provided to attach spout apparatus 30 with dispenser base 60 and the rest of the toy 20. Engagement tabs 39 may release from dispenser base 60 in the event that the toy 20 is dropped, allowing the spout apparatus 30 to separate without damage. Such an embodiment may improve the durability of toy 20.

While sometime referred to herein as handle 47, it will be understood that other ways of controlling actuator mechanism 40 to select and to control the left and right bands 43, 44 for withdrawal or for protrusion through opening 33 of spigot 31 may be provided. For example, a button may be provided instead of, or in addition, to handle 47 to control rotation of actuator disk 45. That is, a button, for example, on the right side of spigot 31, may be used to rotate actuator disk 45 to a first position, and a second button, for example positioned on the left side of the spigot 31, may be used to rotate actuator disc 45 to withdraw the right band 43 and to extend through opening 33 the left band 44. For example, such left and right buttons may be connected to compression springs or may expel air so as to urge movement or rotation of the actuator disc 45 to effectuate control over the bands. Similarly, a center button may be provided in addition to, or instead of, handle 47, to cause actuator mechanism 40 to withdraw both left and right bands 43, 44. Also, types of interaction devices, other than handles and buttons, to set in motion actuation mechanism 40 not specifically described herein are also contemplated and may be provided to control withdrawal or protrusion of left and right bands 43, 44.

Various materials, including injection molded or other plastic, metal, wood, particle board, papier mache, and the like, may be used alone or in combination in the manufacture of each component of the toy selectable beverage dispenser 20 described herein. Components described or illustrated separately may be manufactured as integrally formed together, and components described as integrally formed may be formed separately.

While the invention has been particularly shown and described with reference to exemplary embodiments thereof, the invention is not limited to these embodiments. It will be understood by those of ordinary skill in the art that various changes in form and details may be made therein without departing from the spirit and scope of the invention as defined by the following claims. Also, features shown or described for one embodiment or example may be used in other embodiments or examples. Accordingly, combinations of features not specifically illustrated or discussed are also contemplated and are within the spirit and scope of the invention. Therefore, the description should not be construed as limiting the scope of the invention.

What is claimed is:

1. A toy simulating a selectable beverage dispenser comprising:

a spigot having an opening and housing a first band of a first color and a second band of a color different from the first color; and a handle connected to an actuator and configured to move the actuator to a first position and to a second position;

wherein, when the actuator is moved to the first position, the actuator moves the first band to protrude out through the opening of the spigot and to withdraw the second band through the opening of the spigot so that the second band is entirely within the spigot;

wherein when the actuator is moved to the second position, the actuator moves the second band to protrude out through the opening of the spigot and to withdraw the first band through the opening of the spigot so that the first band is entirely within the spigot.

2. The toy according to claim 1, wherein the actuator comprises an actuator disk connected to the handle, wherein the handle rotates the disk clockwise to attain the first position, and the handle rotates the disk counterclockwise to attain the second position.

3. The toy according to claim 2, wherein the handle rotates the actuator disk about a horizontal axis and the opening of the spigot faces downward.

4. The toy according to claim 1, wherein the actuator comprises a block positioned inside the spigot, the block comprising an outer surface, wherein to attain the first position the actuator winds at least a portion of the first band around a first portion of the outer surface of the block and unwinds at least a portion of the second band from a second portion of the outer surface, and wherein to attain the second position the actuator winds at least the portion of the second band around the second portion of the outer surface of the block and unwinds at least the portion of the first band from the first portion of the outer surface.

5. The toy according to claim 4, wherein the actuator comprises an actuator disk, and wherein moving the handle rotates the actuator disk and the block.

6. The toy according to claim 4, further comprising a spout disk connected with the spigot, and a base, wherein the actuator comprises an actuator disk held rotatably captive between the spout disk and the base.

7. The toy according to claim 1, wherein each of the first and second bands comprises one or more of a string, a strip of fabric, a soft plastic material, or a synthetic rubber.

8. The toy according to claim 1, wherein the handle is configured to rotate the actuator to a third position, wherein to attain the third position the actuator withdraws the first and second bands through the opening of the spigot so that the first and second bands are entirely within the spigot.

9. The toy according to claim 1, wherein to attain the first position of the actuator, the handle is moved to a first handle position toward a righthand side of a user, and to attain the second position of the actuator the handle is moved to a second handle position toward a lefthand side of the user.

10. The toy according to claim 9, wherein the handle is configured to be moved to a third handle position between the first and second handle positions, wherein the actuator is configured to attain a third position when the handle is moved to the third handle position, wherein when the actuator attains the third position of the actuator, the actuator withdraws the first and second bands through the opening of the spigot so that the first and second bands are entirely within the spigot.

11. The toy according to claim 1, wherein the toy simulates a slushy beverage dispenser.

12. The toy according to claim 1, further comprising a transparent or translucent spout disk connected with the spigot, and a colored disk positioned behind the transparent or translucent spout disk, wherein moving the handle rotates the colored disk about a horizontal axis, the rotation of the colored disk being visible to a user through the transparent or translucent spout disk.

13. A toy simulating a refreshment dispensing station comprising the toy according to claim 1, and further comprising:

a toy snow cone dispenser.

14. A toy simulating a selectable beverage dispenser comprising:

a spigot having an opening and housing a first band of a first color and a second band of a color different from the first color;

a handle connected to an actuator and configured to move the actuator to a first position and to a second position;

wherein when the actuator is moved to the first position, the actuator moves the first band to protrude out through the opening of the spigot and to withdraw the second band through the opening of the spigot so that the second band is entirely within the spigot;

wherein when the actuator is moved to the second position, the actuator moves the second band to protrude out through the opening of the spigot and to withdraw the first band through the opening of the spigot so that the first band is entirely within the spigot, wherein the actuator comprises an actuator disk connected to the handle, wherein the handle rotates the disk clockwise to attain the first position, and the handle rotates the disk counterclockwise to attain the second position; and a block positioned inside the spigot, the block connected to the actuator disk and configured to rotate with the actuator disk, the block comprising an outer surface, wherein to attain the first position the actuator winds at least a portion of the first band around a first portion of the outer surface of the block and unwinds at least a portion of the second band from a second portion of the outer surface, and wherein to attain the second position the actuator winds at least a portion of the second band around a second portion of the outer surface of the block and unwinds at least a portion of the first band from the first portion of the outer surface.

15. A toy simulating a selectable beverage container comprising:

a rotatable spindle having an axis of rotation arranged horizontally;

a band connected with the spindle and arranged to wind onto and off the spindle; and a spigot arranged around at least a portion of the spindle, wherein the spigot comprises one or more openings arranged to allow the band to extend downward from the spindle, wherein rotation of the spindle in a first direction causes the band to unwind from the spindle and extend from the spigot and rotation in a second direction causes the band to wind onto the spindle and withdraw into the spigot.

* * * * *